US005251590A

United States Patent [19]

Faletti et al.

[11] Patent Number: 5,251,590

[45] Date of Patent: Oct. 12, 1993

[54] METHOD AND APPARATUS FOR STARTING AN ENGINE UTILIZING UNIT VALVE ACTUATION

[75] Inventors: James J. Faletti, Spring Valley; Yung T. Bui, Peoria Heights, both of Ill.

[73] Assignee: Caterpillar Inc., Peoria, Ill.

[21] Appl. No.: 891,617

[22] Filed: Jun. 1, 1992

[51] Int. Cl.[5] ..... F02N 17/00

[52] U.S. Cl. ..... 123/179.21

[58] Field of Search ..... 123/179.21, 179.1, 90.11

[56] References Cited

U.S. PATENT DOCUMENTS

| | | | |
|---|---|---|---|
| 4,075,990 | 2/1978 | Ribeton | 123/559 |
| 4,210,109 | 7/1980 | Nakajima et al. | 123/76 |
| 4,424,790 | 1/1984 | Curtil | 123/559 |
| 4,561,253 | 12/1985 | Curtil | 60/606 |
| 4,624,228 | 11/1986 | Sahara et al. | 123/378 |
| 4,641,613 | 2/1987 | Delesalle | 123/179.21 |
| 4,722,315 | 2/1988 | Pickel | 123/568 |
| 4,945,870 | 8/1990 | Richeson | 123/179.21 |
| 5,005,552 | 4/1991 | Kawamura | 123/571 |
| 5,086,738 | 2/1992 | Kubis et al. | 123/322 |

FOREIGN PATENT DOCUMENTS

| | | | |
|---|---|---|---|
| 3027415 | 2/1982 | Fed. Rep. of Germany . | |
| 2259998 | 8/1975 | France | 123/179.21 |
| 230911 | 9/1990 | Japan . | |
| 0705134 | 8/1979 | U.S.S.R. . | |
| 2134596 | 8/1984 | United Kingdom . | |

*Primary Examiner*—Andrew M. Dolinar
*Attorney, Agent, or Firm*—Larry G. Cain

[57] ABSTRACT

Starting systems for use with internal combustion engine have in the past used a variety of add on mechanical mechanisms to provide cold starting. Many of these systems fail to provide the option of controllably and modulatively varying the sequence and amount of the opening and closing of an intake or exhaust valve relative to a piston position in a cylinder bore. The present invention provides an electronic control system outputting an discrete control signal, and an opening device for unit actuation of each of the pair of valves independently. The electronic control system is programmable to respond in a first predetermined logic pattern for conventional operation of the engine at which time each of the pair of valves is in the open position during the exhaust stroke. The electronic control system is programmable to a second predetermined logic pattern to vary the operation of the valves associated with the respective bore in the generally closed position for a portion of the exhaust stroke before top dead center during the exhaust stroke of the piston. The preestablished logic pattern controllably, sequentially and modulateably actuate the device for unit actuation, moving each of the valves independently between the open and closed position to effectively increase the heat within the during the movement of a piston from a bottom dead center position to a top dead center position.

20 Claims, 2 Drawing Sheets

METHOD AND APPARATUS FOR STARTING AN ENGINE UTILIZING UNIT VALVE ACTUATION

DESCRIPTION

1. Technical Field

The present invention relates generally to the controlled operation of engine operating modes. More particularly, the invention relates to a preestablished logic pattern, each cycle being adaptable to varying the preestablished logic pattern and the preestablished logic pattern controllably, sequentially and modulateably controlling valve timing to provide an improved engine starting system.

2. Background Art

Starting of diesel engines at cold ambient temperature can be difficult. Other problems associated after starting has been the production of white smoke. Both starting and white smoke are attributed to the inability of the engine to both ignite and completely burn the fuel delivered into the cylinder. The ability to ignite the fuel is dependent on cylinder temperatures during the period of fuel injection. Higher temperatures during this period make it easier for combustion to take place. Current methods used to accomplish higher temperatures include coolant heater which raise the wall temperature on the combustion chamber, air pre-heaters which raise the intake manifold air temperature and the addition of fuels, such as ether, which can ignite at lower temperatures.

An example of a device used to increase the temperature of the intake air is disclosed in U.S. Pat. No. 4,201,109 issued to Yasuo Nakajima et al. on Jul. 1, 1980. In this patent, an internal combustion engine has a first group of cylinders and at least one second cylinder acting as an air pump for the admission of scavenged air into the first group of cylinders. Thus, the second cylinder preheats the air during compression for admission to the first group of cylinders.

Another example of a device used to increase the temperature of the intake air is disclosed in U.S. Pat. No. 4,624,228 issued to Masanori Sahara et al. on Nov. 25, 1986. An intake system discloses a timing valve which is opened in the final period of the intake stroke so that a strong suction pressure is produced in the combustion chamber before the timing valve is opened. When the timing valve is opened, the intake air rushes into the combustion chamber at a high speed, whereby the intake air is compressed under the inertial of the high speed flow increasing the quantity of air to be compressed increasing the temperature of the combustion air.

The devices described above are used to increase the temperature within the cylinder. They require additional hardware other than conventional necessary engine components. The result being increased customer cost and the greater possibility of hardware failure due to the increased number of components.

The present invention is directed to overcome one or more of the problems as set forth above.

DISCLOSURE OF THE INVENTION

In one aspect of the invention, a starting system is adapted for use with an engine. The engine includes a passage, a pair of bores and a piston which during operation of the engine is movably positioned within respective bores between a top dead center position and a bottom dead center position forming an expansion stroke and the reciprocal movement of the piston forming an exhaust stroke. A pair of valves are operatively associated with the passage and communicates between the passage and respective bores. The valves have a closed position and an open position. A means for opening each of the valves independently in response to receiving a control signal is included with the engine. An electronic control system is connected to the opening means and outputs the control signals to the opening means in a first predetermined logic pattern during normal engine operation. During the first logic pattern one of the pair of valves are in the generally open position during the exhaust stroke before the top dead center position. The starting control means is connected to the electronic control system and causes discrete control signals to be outputted to the opening means in a second predetermined logic pattern. The second logic pattern varies the operation of the valves so that each of the pair of valves associated with the respective bores is in the generally closed position for a portion of the exhaust stroke before top dead center effectively increasing the heat within the engine during the movement of the piston within the respective bore from a bottom dead center position to the top dead center position.

In another aspect of the invention, an engine has a passage, a pair of bores and a piston which is movably positioned within respective bores between a top dead center position and a bottom dead center position during operation of the engine forming an expansion stroke and the reciprocal movement of the piston forming an exhaust stroke. A pair of valves are operatively associated with the passage and communicates between the passage and the respective bores. The pair of valves have a closed position and an open position. A means for opening each of the valves independently in response to receiving a control signal is included in the engine. An electronic control system is connected to the opening means and outputs the control signals to the opening means in a first predetermined logic pattern. In the first logic pattern, during normal engine operation, one of the pair of valves are generally open during the exhaust stroke. The invention is characterized in that a starting control means is connected to the electronic control system and causes discrete control signals to be outputted to the opening means in a second predetermined logic pattern. The second logic pattern varies the operation of the valves so that each pair of valves associated with the respective bore is in the generally closed position for a portion of the exhaust stroke before top dead center. The results effectively increase the heat within the engine during the movement of the piston within the respective bore from a bottom dead center position to the top dead center position.

In another aspect of the invention, a method for starting an engine is comprised the following steps: moving a device into an on position, activating a starting control means, causing a crankshaft of the engine to rotate moving a piston between a bottom dead center position and a top dead center position, and monitoring the operating mode of the engine using a plurality of sensors. The steps are further comprised of sending a signal from the sensors to a processing means, outputting a control signal from the processing means to an opening means and opening a valve during only a portion of an exhaust stroke wherein said piston is near the bottom dead center position.

BEST MODE FOR CARRYING OUT THE INVENTION

Figure 1:
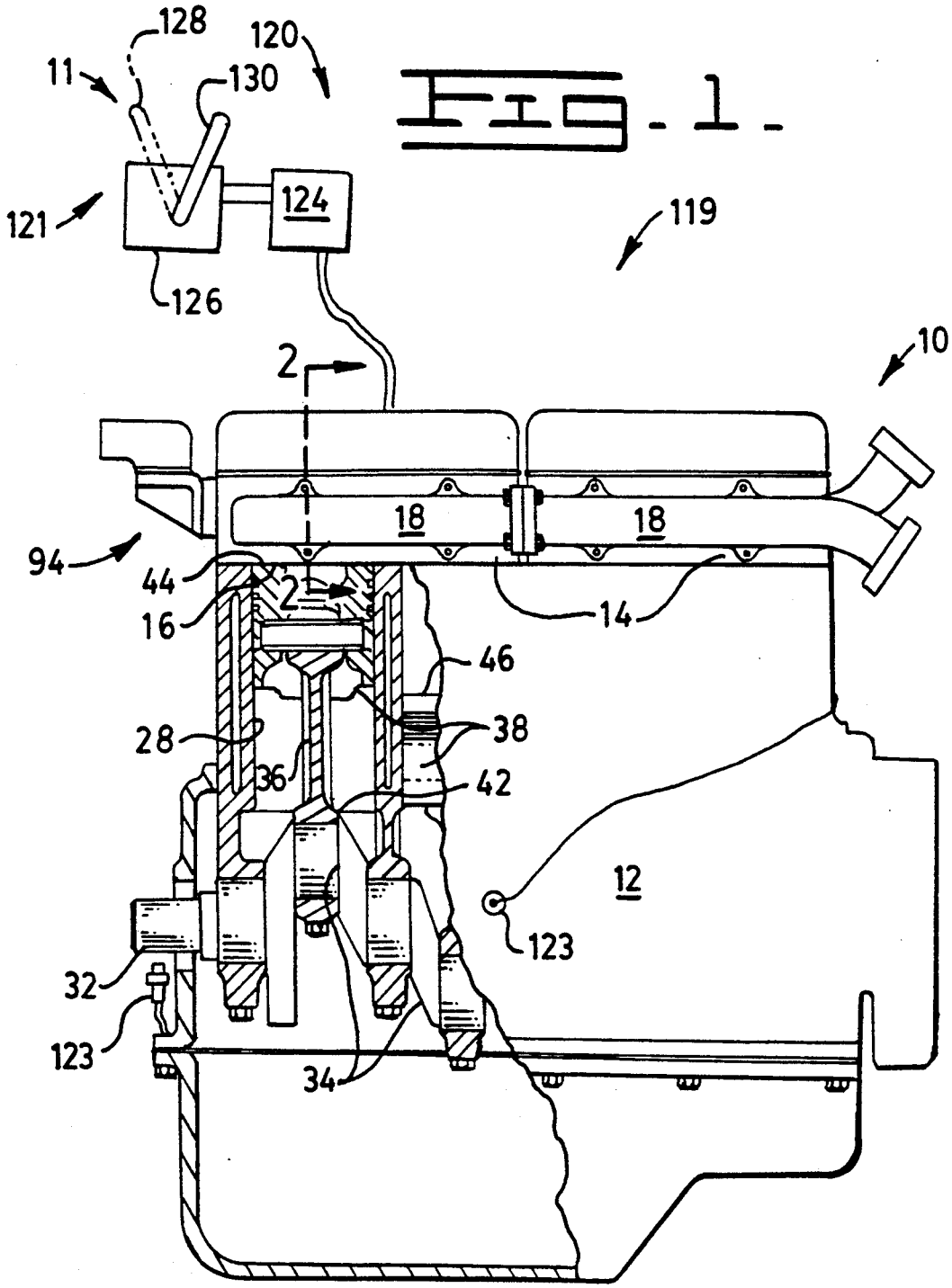
FIG. 1 is a partially sectioned side view of an engine having an embodiment of the present invention.

Referring to FIG. 1, an internal combustion engine 10 having a conventional four cycles of compression, expansion, exhaust and intake strokes includes an engine starting system 11 which has been adapted for use with the engine 10. The engine 10 includes a block 12 and a plurality of cylinder heads 14 rigidly attached to the block 12. A single cylinder head 14 could be used without changing the essence of the invention. Furthermore, the block 12 and the cylinder head could be of an integral design. Each of the cylinder heads include a combustion surface 16 defined thereon. An intake manifold 18 is attached to a mounting face 20 of each cylinder head 14 and an exhaust manifold 22 is attached to a mounting face 23 of each cylinder head 14.

The block 12 includes a top face 26 having a plurality of machined cylinder bores 28 therein, of which only a pair is shown. As an alternative, the block 12 could include a plurality of replaceable cylinder liners, not shown, positioned within the bores 28, without changing the essence of the invention. A crankshaft 32 having a plurality of throws 34 thereon is rotatably positioned within the block 12 in a conventional manner. A plurality of connecting rods 36 are rotatably attached to the crankshaft 32 and to a plurality of pistons 38 in a conventional manner. Each of the pistons 38, in this application, is of a single piece design. The pistons 38 could be of an articulated type design without changing the gist of the invention. Each piston 38 and a portion of the connecting rod 36 attached thereto are positioned within a respective bore 28 in a conventional manner. Rotation of the crankshaft 32 causes individual throws 34 to move the piston 38 within the bore 28 a preestablished distance. Rotation of the crankshaft 32 causes the piston 38 to move toward the combustion surface 16 of the cylinder head 14 and further rotation of the crankshaft throw 34 causes the piston 38 to move away from the combustion surface 16. As the throw 34 reaches an apex 42 of rotation, the piston 38 is at a top dead center (TDC) position 44. Subsequently, as the throw 34 reaches a position 180 degrees from the apex 42, the piston 38 is at a bottom dead center (BDC) position 46. Each combination of the throw 34, connecting rod 32 and piston 38 follow a similar path.

Figure 2:
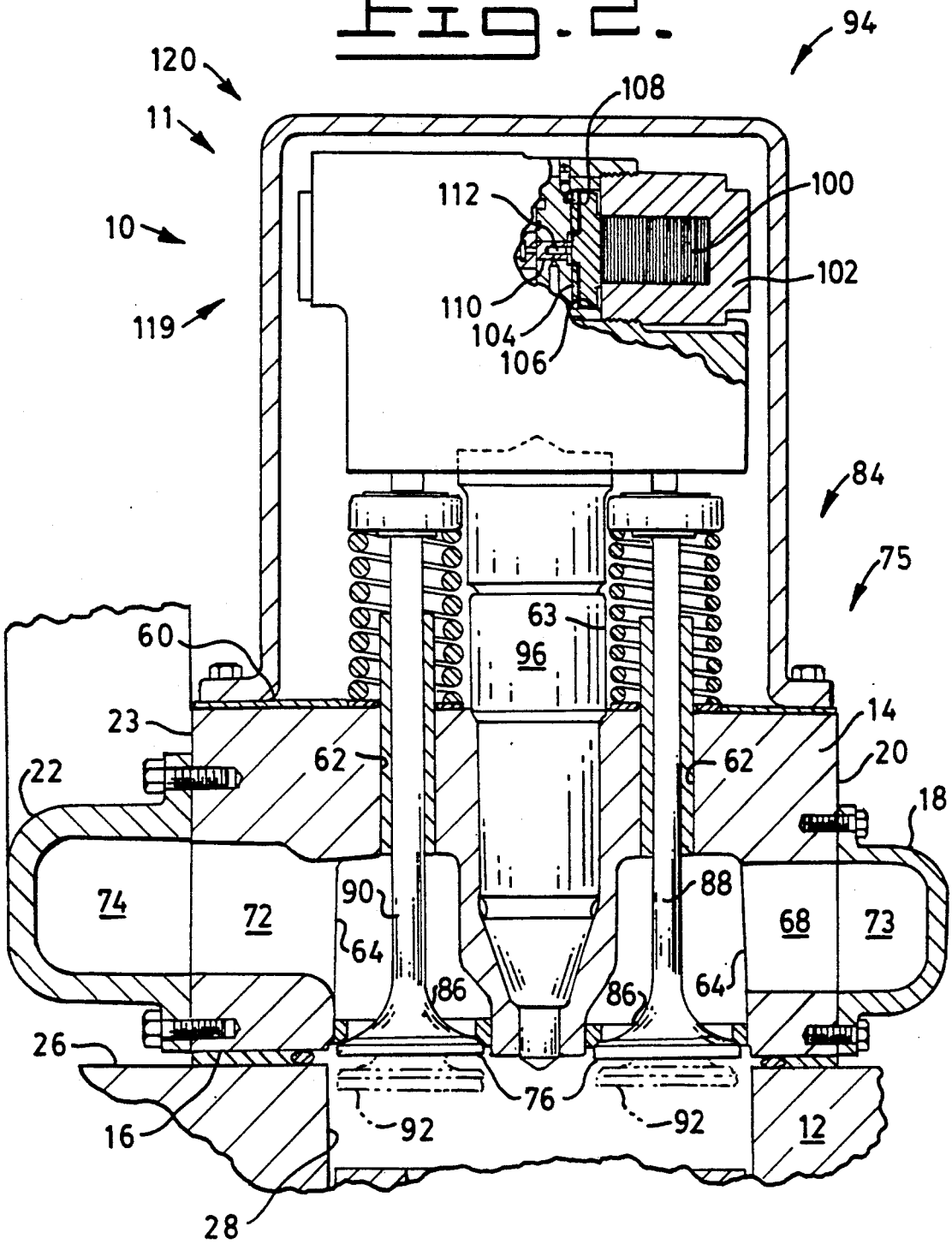
FIG. 2 is a partially sectioned view taken along lines 2—2 of FIG. 1.

As best shown in FIG. 2, the cylinder head 14 further includes a top deck 60 spaced from the combustion surface 16 a preestablished distance. A plurality of valve bores 62 axially extend between the top deck 60 and the combustion surface 16 and a plurality of injector bores 63 axially extend between the top deck and the combustion surface 16. The plurality of valve bores 62 have an enlarged portion 64 extending from the combustion surface 16 toward the top deck 60 a predetermined distance. A plurality of intake passages 68 are positioned within the head 14 and communicate between one of the enlarged portions 64 and the mounting face 20 in a conventional manner. Further positioned within the head 14 are a plurality of exhaust passages 72 which communicate between one of the enlarged portions 64 and the mounting face 23. The intake passages 68 are in fluid communication with an intake manifold passage 73 positioned in the intake manifold 18 and the exhaust passages 72 are in fluid communication with an exhaust manifold passage 74 positioned in the exhaust manifold 22.

A cylinder head assembly 75 includes a pair of valves 76 positioned within the plurality of bores 62 and are removably attached within the cylinder head 16 in a conventional manner. Each of the pair of valves 76, in the assembled position, is retained in sealing contact with the head 16 by a conventional spring means 84 and defines a closed position 86 a first of the pair of valves 76 is an intake valve 88 and another one of the pair of valves 76 is an exhaust valve 90. The pair of valves 76 could include a single intake and exhaust valve 88,90 or a combination of multi intake and exhaust valves 88,90. Each of the pair of valves 76 is moved independently into an open position 92 by a means 94 for electronically opening each of the valves 76. In the open position 92, the volume within the bore 28 is in fluid communication with at least one of the intake passages 68 and the intake manifold passage 73, or the exhaust passages 72 and the exhaust manifold passage 74. Positioned within each of the injector bores 63 is a unit fuel injector 96 of a conventional design. The unit fuel injector 96 is also opened by the means 94 for opening. As an alternative, any conventional fuel system could be used.

In a preferred embodiment, the means 94 for opening each of the valves 76 independently include a like number of piezoelectric motors 100, only one shown, although it could be one of any number of types such as solenoids, voice coils, or linear displaceable electromagnetic assemblies. The piezoelectric motor 100, which is well-known in the art, expands linearly responsive to electrical excitation by a preestablished quantity of energy and contracts when the electrical excitation is ended. Variations in the amount of electrical excitation will cause a similar variation in the linear expansion of the motor 100. For example, full electrical excitation will linearly move a greater distance than half electrical excitation. In the above example, the ratio of distance moved being approximately 2 to 1. The motor 100 is housed in a piezo-housing 102. Adjacent the piezo-housing 102 is a piston housing 104 having a stepped cavity 106 in which are positioned a driver piston 108, an amplifier piston 110, and a fluid chamber 112 therebetween.

The piezoelectric motor 100 can generate high force in the linear direction, however, its linear expansion is much less than the linear displacement required to move the pair of valves 76 from the closed position 86 to the open position 92. Therefore, the driver piston 108, amplifier piston 110 and fluid chamber 112 are provided to translate and amplify linear displacement of the motor 100 into linear displacement in the following manner. The amplifier piston 110 is sized much smaller than the driver piston 108 because the hydraulic amplification ratio of the linear displacement of the driver piston 108, as it relates to the linear displacement of the amplifier piston 110, is inversely proportional to the surface area ratio of the driver piston 108 to the amplifier piston 110. Thus, small linear displacement of the motor 100 is amplified to produce significantly greater linear displacement of the amplifier piston 110.

An electronic control system 119 is connected to the opening means 94 and has a control signal 120 directed therefrom to the opening means 94 to functionally control the engine 10 in a first predetermined logic pattern in which one of the pair of valves 76 are opened during the exhaust stroke. For example, during normal engine 10 operation the exhaust valves 90 are moved into the open position 92 during the expansion stroke when the piston 28 is approaching bottom dead center 46 and remains in the open position 92 through the exhaust stroke as the piston 28 moves from bottom dead center 46 to top dead center 44.

The engine starting system 11 includes a starting control means 121 for causing the control signals to be outputted to the opening means 94 in a second predetermined logic pattern different than the first predetermined logic pattern, thus forming a starting or cold operating mode. The starting control means 121 include the electronic control system 119, the modified control signal 120, and a plurality of engine sensors 123 which relay information concerning the operating conditions of the engine 10, for example, temperature, rpm's, load, air-fuel mixture, etc. in a conventional manner such as by wires or radio type signals, to a processing means or a microprocessor 124. The microprocessor 124 uses a preprogrammed logic to process the data provided by the sensors 123 and based upon the results of the analysis outputs the control signal 120 to supply current to the various piezoelectric motors 100. The motors 100 are actuated independently of each other and thus, the intake valves 88, exhaust valves 90 and unit fuel injectors 96 are independently controlled so as to produce optimum timing events of valve opening and fuel injection for various engine 10 operating conditions.

The starting control means 121 for causing the control signal 120 to be outputted to the opening means 94 further include a device 126 which is movable between an off position 128 and an on position 130. In this application, the device is manually positioned by an operator. As an alternative the device 126 could be automatically actuated as the conditions monitored by the sensors 123 are fed to the microprocessor and interpreted to require the actuation of the starting or cold operating mode.

Engine starting effectiveness can further be increased by controlling the position of the valve lift between the closed position 86 and the fully open position 92. The increased lift of the valve 90 allows the evacuation of the fluid, which in this application is combustion air and fuel or as an alternative air, from the cylinder or bore 28 in a shorter time. For example, computer simulation has shown that a valve lift of about 2 mm showed a significant increase in the evacuation of the fluid within the bore 28 over a valve lift of about 1 mm. Therefore, since it is the objective to increase the heat within the bores 28, if we reduced the conventional valve lift to about 80 percent of the lift the hot combusted air can not escape from the bores 28 as fast and a greater amount of heat will be absorbed in the bores 28. Furthermore, as the lift is reduced more air is retained within the bores 28 and the movement of the piston 38 toward the top dead center position 44 partially compresses the combustion air and fuel increasing the temperature within the bores 28.

Industrial Applicability

In use, the engine utilizes the opening means 94 to unit actuate each of the valves 76 independently. The opening means 94 allow the freedom to change timing of the pair of valve 76 events independently of crankshaft 32 rotational position. The opening means 90 having the ability to actuate each pair of valves 76 independently and the valve timing flexibility allows for better modulation of the starting system 11. For example, in operation, prior to starting the engine 10 the operator moves the device 126 into the on position 130 and the starting control means 121 is activated. The sensors 123 monitor the cold operating mode by monitoring such variables as water temperature, exhaust temperature and/or amount of unburned fuel within the exhaust. As these condition move from the cold operating mode to that of a hot engine the microprocessor 124 automatically switch the device 126 from the on position 130 to the off position 128.

In the on position 130 or cold operating mode, the object is to raise the cold operating mode temperature within the cylinder or bore 28 which, in turn shortens the ignition delay period, thus, resulting in easier starting as well as reduced white smoke. Functionally, in this application the exhaust valve 90 is advanced to remain closed up to between about 30 to 45 degrees before top dead center 44 during the exhaust stroke of the engine 10. In this application, the exhaust valve 90 remains closed up to about 36 crank degrees before top dead center (BTDC) and the lift of the exhaust valves 90 is decreased by approximately 80 percent during the exhaust stroke. In one example, the results of the above increased the combustion temperature by approximately 25 degrees. This is the equivalent of raising the compression ratio from 16:1 to 17:1 or having the ambient temperature at 97 degrees instead of 77 degrees Fahrenheit. The freedom in valve 76 timing allows duplication of the above described cycle by adjacent bores 28 further increasing the operating temperature and further decreasing the white smoke at a faster rate, thus, reducing the time in which the engine remains in the starting or cold operating mode.

Stated slightly differently, when the piston 38 is in the expansion stroke the valves 76 are generally in the closed position 86 except for possibly near the end of the expansion stroke and in another case when the piston 38 is in the intake stroke one of the pair of valves 76 is the open position 92 for communication with the passage 73,74. The piston 38 can also be movable positioned within the respective bores 28 between the bottom dead center position 46 and a top dead center position 44 forming in one case the compression stroke where the valves 76 are generally in the closed position 86 except for possibly very early in the compression stroke and in another case the exhaust stroke where one of the pair of valves 76 is the generally open position 92.

As a further explanation, the second predetermined logic pattern varies the operation of the valves 76 so that each of the pair of valves 76 associated with the respective bores 28 is in the generally closed position 86 for a portion of the exhaust stroke before top dead center 44, effectively increasing the temperature and pressure within the respective bore 28 during the movement of the piston 38. The beginning of the ensuing intake stroke where another of the pair of valves 76 is open will first allow the higher temperature and pressure air within the bore 28 to flow into one of the passages 73,74 raising the temperature and pressure. This will be followed by, the flow from the passage 73,74 to the respective bore 28 of the relatively warmer air which thus increases the heat in the bore 28 during the ensuing compression stroke. This higher level of heat maintained in the bore 28 during the compression stroke will aid starting of the engine 10.

The present invention provide an efficient and cost effective starting system 11 without the addition of expensive mechanical mechanisms. The electronic control system 119 can be utilized to activate the opening means 94 to vary the conventional first predetermined logic pattern and provide a cold operating mode. The individual actuation of the pair of valves 76 makes it possible to control the opening position 92, closing position 86, and the lift of each position 92,86 of the valves 76 independently of the crankshaft 32 angle. Thus, a more efficient cost effective starting system 11 can be utilized.

Other aspects, objects and advantages of this invention can be obtained from a study of the drawings, the disclosure and the appended claims.

We claim:

1. A starting system adapted for use with an engine having a conventional four cycle including an intake stroke, a compression stroke, an expansion stroke and an exhaust stroke and including a passage, a pair of bores, a piston during operation of the engine being movably positioned within respective bores between a top dead center position and a bottom dead center position forming the expansion stroke and the reciprocal movement of the piston forming the exhaust stroke;

a pair of valves each being operatively associated with the passage and communicating therebetween the passage and the respective bores and having a closed position and an open position;

means for opening each of the valves independently in response to receiving a control signal;

an electronic control system connected to the opening means and outputting the control signals to the opening means in a first predetermined logic pattern during normal engine operation wherein one of said pair of valves in the generally open position during the exhaust stroke before top dead center position; and starting control means connected to the electronic control system for causing discrete control signals to be outputted to the opening means in a second predetermined logic pattern to vary the operation of the valves retaining an exhaust valve in the closed position for a portion of the exhaust stroke so that each of the pair of valves associated with the respective bores is in the generally closed position for a portion of the exhaust stroke before top dead center effectively increasing the heat within the engine during the movement of the piston within the respective bore from a bottom dead center position toward the top dead center position.

2. The starting system of claim 1 wherein said exhaust valve is retained in the closed position during the exhaust stroke up to about 30 to 45 degrees before top dead center position.

3. The starting system of claim 2 wherein said exhaust valve is retained in the closed position during the exhaust stroke up to about 36 degrees before top dead center position.

4. The starting system of claim 1 wherein said second predetermined logic pattern varies the operation of a portion of the valves positioning the valves in a position intermediate the closed position and the open position.

5. The starting system of claim 4 wherein said valves positioned intermediate the closed position and the open position is an exhaust valve.

6. The starting system of claim 5 wherein said open position has a preestablished lift.

7. The starting system of claim 6 wherein said position intermediate the closed position and the open position has a preestablished lift of about 80 percent of the preestablished lift of the open position.

8. The starting system of claim 1 wherein said opening means include a piezoelectric motor.

9. An engine having a conventional four cycle including an intake stroke, a compression stroke, an expansion stroke and an exhaust stroke and having a passage, a pair of bores, a piston during operation of the engine being movably positioned within respective bores between a top dead center position and a bottom dead center position forming an expansion stroke and the reciprocal movement of the piston forming an exhaust stroke, a pair of valves operatively associated with the passage and communicating between the passage and the respective bores, and having a closed position and an open position, means for opening each of the valves independently in response to receiving a control signal, an electronic control system connected to the opening means and outputting the control signals to be outputted to the opening means in a first predetermined logic pattern during normal engine operation wherein one of said pair of valves is generally open during the exhaust stroke, characterized in that; starting control means being connected to the electronic control system for causing discrete control signals to be outputted to the opening means in a second predetermined logic pattern varying the operation of the valves retaining an exhaust valve in the closed position for a portion of the exhaust stroke so that each pair of valves associated with the respective bore is in the generally closed position for a portion of the exhaust stroke before top dead center effectively increasing the heat within the engine during the movement of the piston within the respective bore from a bottom dead center position toward the top dead center position.

10. The engine of claim 9 wherein said exhaust valve is retained in the closed position during the exhaust stroke up to about 30 to 45 degrees before top dead center position.

11. The engine of claim 10 wherein said exhaust valve is retained in the open position during the exhaust stroke up to about 36 degrees before top dead center position.

12. The engine of claim 9 wherein said second predetermined logic pattern varies the operation of the valves positioning the valves in a position intermediate the closed position and the open position.

13. The engine of claim 12 wherein said valves positioned intermediate the closed position and the open position is an exhaust valve.

14. The engine of claim 13 wherein said open position has a preestablished lift.

15. The engine of claim 14 wherein said position intermediate the closed position and the open position has a preestablished lift being about 80 percent of the preestablished lift of the open position.

16. The engine of claim 9 wherein said opening means includes a piezoelectric motor.

17. A method for starting an engine having a conventional four cycle including an intake stroke, a compression stroke, an expansion stroke and an exhaust stroke and comprising the steps of:

(a) moving a device into an on position;

(b) activating a starting control means;

(c) causing a crankshaft of the engine to rotate moving a piston between a bottom dead center position and a top dead center position;

(d) monitoring the operating mode of the engine using a plurality of sensors;

(e) sending a signal from the sensors to a processing means;

(f) outputting a control signal from the processing means to an opening means; and (g) holding an exhaust valve in a closed position up to about 36 degrees crankshaft angle before top dead center during the exhaust stroke.

18. The method of starting an engine of claim 17 wherein the step of moving a device into an on position is manually activation by an operator.

19. The method of starting an engine of claim 17 wherein the step of moving a device into an on position is automatically activated.

20. The method of starting an engine of claim 17 wherein said step of holding an exhaust valve in a closed position includes using a piezoelectric motor.

* * * * *

UNITED STATES PATENT AND TRADEMARK OFFICE

CERTIFICATE OF CORRECTION

PATENT NO. : 5,251,590

DATED : October 12, 1993

INVENTOR(S) : James J. Faletti et al.

It is certified that error appears in the above-identified patent and that said Letters Patent is hereby corrected as shown below:

IN THE ABSTRACT: Line 25, after "within the" insert the word --bore--.

IN CLAIM 11: Column 8, line 46 "open" should be "closed".

IN THE ABSTRACT: Line 9, "an discrete" should be "a discrete".

IN CLAIM 18: Column 10, line 6, "activation" should be "activated".

Signed and Sealed this

Twenty-fourth Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,251,590

DATED : October 12, 1993

INVENTOR(S) : James J. Faletti, et al.

It is certified that error appears in the above-identified patent and that said Letters Patent is hereby corrected as shown below:

column 6, line 19, "closed" should be --open--.

Signed and Sealed this

Seventeenth Day of October, 1995

*Attest:*

*Attesting Officer*

BRUCE LEHMAN

*Commissioner of Patents and Trademarks*